United States Patent [19]

Suzuki

[11] Patent Number: 4,515,467

[45] Date of Patent: May 7, 1985

[54] MAGNET BRUSH CLEANING APPARATUS FOR ELECTROPHOTOGRAPHIC COPYING MACHINE

[75] Inventor: Kohji Suzuki, Yokohama, Japan

[73] Assignee: Ricoh Company, Ltd., Tokyo, Japan

[21] Appl. No.: 457,548

[22] Filed: Jan. 12, 1983

[30] Foreign Application Priority Data

Jan. 20, 1982 [JP] Japan ..... 57-6991

[51] Int. Cl.[3] ..... G03G 21/00

[52] U.S. Cl. ..... 355/15; 118/652; 15/256.52

[58] Field of Search ..... 355/15, 3 R; 118/652; 15/1.5, 256.52

[56] References Cited

U.S. PATENT DOCUMENTS 3,926,517 12/1975 Nagahara ..... 355/15 X
3,950,089 4/1976 Fraser et al. ..... 355/15 X
4,436,412 3/1984 Yamagata et al. ..... 355/15

*Primary Examiner*—Richard L. Moses
*Attorney, Agent, or Firm*—David G. Alexander

[57] ABSTRACT

A magnet brush cleaning apparatus for removing a toner which has been left non-transferred on the surface of a photoconductive element. The residual toner is attracted by and supported on a rotary sleeve on which a magnetic carrier forms a magnet brush. The magnetic carrier separated from the magnet brush and the residual toner are separated from each other by an electrode which is disposed in a circulatory carrier supply path in order to develop an intense electric field. The thus separated carrier is returned to the sleeve. The electrode may take the form of a roller, a plate or a wire. The residual toner on the photoconductive element has its amount of charge reduced in advance by a discharging unit. A substantial amount of the residual toner is scraped off the photoconductive element by a fur brush. A desired amount of the carrier is discharged and replenished automatically in response to lowering of the cleaning ability of the apparatus.

30 Claims, 7 Drawing Figures

MAGNET BRUSH CLEANING APPARATUS FOR ELECTROPHOTOGRAPHIC COPYING MACHINE

BACKGROUND OF THE INVENTION

The present invention relates to a cleaning apparatus capable of effectively removing residual part of a toner which is left non-transferred on the surface of a photoconductive element, which serves as an image support in an electrophotographic copier or the like. More particularly, the present invention relates to an improved magnet brush cleaning apparatus which promotes efficient collection of the residual toner from a magnetic carrier which constitutes a cleaning agent, saves consumption of the carrier, prolongs the service life of the carrier, and permits the carrier to be automatically replenished and replaced.

Various systems have heretofore been proposed for the removal of a residual toner from a photoconductive element or like image support such as one using a fur brush, a blade and a webbing, or a magnet brush. In the magnet brush type system, a magnet brush of magnetic carrier or the like may be magnetically formed on a rotary sleeve located adjacent to the photoconductive element. In this case, the residual toner magnetically deposited on the magnet brush will be electrostatically transferred onto a collector roller in the vicinity of the sleeve and then scraped off the collector roller by a blade or the like.

In this type of cleaning system, the transfer of the toner from the sleeve to the collector roller is facilitated by the application of a bias voltage opposite in polarity to a charge deposited on the toner across the sleeve and the use of a conductive collector roller which is impressed with a second bias voltage higher than the first. Where the bias voltage to the sleeve lies within the range of 200–400 V, for example, the bias voltage to the collector roller has to be as high as about 600–800 V. Such a high bias voltage to the collector roller tends to cause a leak current to flow from the collector roller to a support system associated therewith. This requires sure insulation and other countermeasures which result in various limitations in practical use.

Meanwhile, what separates the residual toner from the magnet brush or carrier is the mere electrostatic attraction exerted by the collector roller. The toner, therefore, will soon accumulate on the periphery of the magnet brush or carrier thereby rendering the carrier incapable of attracting any more residual toner. Thus, apart from the limited life of the carrier, the accumulation of the toner lowers the frictional charging ability of the carrier to thereby noticeably deteriorate the cleaning efficiency. Furthermore, in a two-component dry-process developing system, the magnetic carrier for cleaning is usually common in quantity and kind to the carrier for development, e.g. iron powder. However, the life or durability of the carrier has been limited to about 10,000–100,000 copies/kg due to the deterioration to the charging ability of the carrier caused by the so-called "toner filming" or the like, introduction of various alien particles such as broken carrier particles and paper powder, etc.

Additionally, because the carrier is liable to adhere to the collector roller and therefore to enter the collected toner by a substantial amount, not only the collected toner tends to become non-reusable but the consumption of the carrier tends to be significantly increased.

The result is the need for frequent services for replacing the carrier with fresh one at the sacrifice of economy.

The blade and webbing type cleaning apparatus, which is another known type of apparatus, is undesirable because the blade or the webbing is held in sliding contact with the surface of a photoconductive element to damage the surface of the latter at a significant rate. The fur brush type cleaning apparatus, on the other hand, suffers from the drawback that the life of the photoconductive element is limited by the toner which tends to remain as a thin film on the surface of the photoconductive element even after moved past the cleaning apparatus, i.e. toner filming.

SUMMARY OF THE INVENTION

A magnet brush cleaning apparatus for removing residual toner left non-transferred on a photoconductive element embodying the present invention comprises a rotatable magnet brush means for cleaning the surface of the photoconductive element by forming a magnet brush by a cleaning agent and attracting the residual toner to support the residual toner on the magnet brush. Electric field developing means develops an electric field in a circulatory cleaning agent supply path and separates the toner collected after the cleaning by the magnet brush means and the cleaning agent from each other. The cleaning agent separated from the toner is supplied to the magnet brush means by cleaning agent supply means.

In accordance with the present invention, a magnet brush cleaning apparatus removes a toner which has been left non-transferred on the surface of a photoconductive element. The residual toner is attracted by and supported on a rotary sleeve on which a magnetic carrier forms a magnet brush. The magnetic carrier separated from the magnet brush and the residual toner are separated from each other by an electrode which is disposed in a circulatory carrier supply path in order to develop an intense electric field. The thus separated carrier is returned to the sleeve. The electrode may take the form of a roller, a plate or a wire. The residual toner on the photoconductive element has its amount of charge reduced in advance by a discharging unit. A substantial amount of the residual toner is scraped off the photoconductive element by a fur brush. A desired amount of the carrier is discharged and replenished automatically in response to lowering of the cleaning ability of the apparatus.

It is an object of the present invention to remarkably improve the cleaning ability of a magnet brush cleaning apparatus for use with an electrophotographic copier or the like.

It is another object of the present invention to cut down the consumption and prolong the life of a magnetic carrier which serves as a cleaning agent in a magnet brush cleaning apparatus.

It is another object of the present invention to enable a magnetic carrier to be automatically replenished and replaced.

It is another object of the present invention to enhance the efficiency of the collection of residual toner from a magnetic carrier.

It is another object of the present invention to prevent electrical leakage from occurring from a residual toner collector roller in a magnet brush cleaning apparatus which is impressed with a bias voltage.

It is another object of the present invention to provide a generally improved magnet brush cleaning apparatus for an electrophotographic copier.

Other objects, together with the foregoing, are attained in the embodiments described in the following description and illustrated in the accompanying drawings.

BRIEF DESCRIPTION OF THE DRAWINGS

FIG. 1 is a schematic view of a prior art magnet brush cleaning apparatus installed in an electrophotographic copier or the like;

DESCRIPTION OF THE PREFERRED EMBODIMENTS

While the magnet brush cleaning apparatus for an electrophotographic copying machine of the present invention is susceptible of numerous physical embodiments, depending upon the environment and requirements of use, substantial numbers of the herein shown and described embodiments have been made, tested and used, and all have performed in an eminently satisfactory manner.

In an ordinary electrophotographic copying process, a latent image corresponding to an image on an original document is formed electrostatically on the surface of a photoconductive element and then developed by a toner. The resulting toner image is transferred onto a sheet of paper while the remaining toner on the photoconductive element is removed by a cleaning apparatus.

Figure 1:
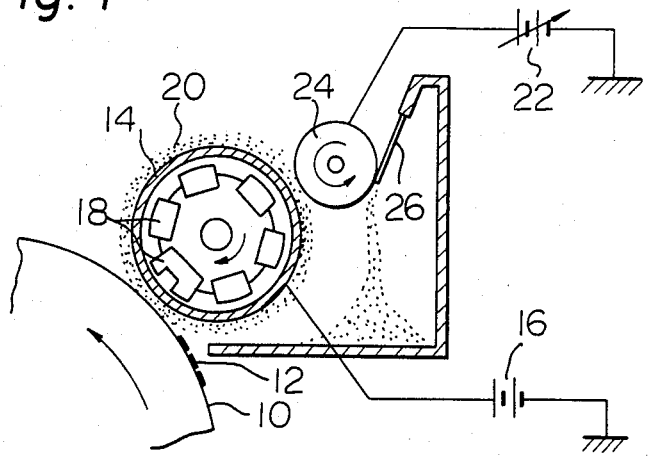

Referring to FIG. 1 of the drawings, a prior art magnet brush cleaning apparatus includes a cylindrical rotary sleeve 14 which is located adjacent to a photoconductive drum 10 and supplied with a bias voltage by a power source 16. The drum 10 is driven at a constant speed as indicated by an arrow in the drawing and carries thereon the residual toner which was not transferred to a sheet. Magnets 18 are accommodated within the sleeve 14. The sleeve 14 is rotatable as indicated by an arrow so that a magnetic carrier serving as a cleaning agent forms a magnet brush 20 and rubs the surface of the drum 10. A toner collector roller 24 neighbors the sleeve 14 and is supplied by a second power source 22 with a second bias voltage which is higher than the bias voltage applied across the sleeve 14. A blade 26 is positioned near the roller 24 to slidingly engage the periphery of the latter.

The residual toner 12 on the drum 10 is caused to adhere to the magnetic carrier, which has been charged by friction with the magnetic brush 20, and entrained thereby to the position of the roller 24. The toner is then transferred to the surface of the roller 24 across which a substantial bias voltage opposite in polarity to the charge on the toner has been applied by the power source 22. Thereafter, the toner is shaved off the roller 24 by the blade 26.

As previously discussed, such a prior art cleaning apparatus is not fully acceptable in performance due to the objectionable consumption and short life of the magnetic carrier, and the poor toner collection efficiency.

Figure 2:
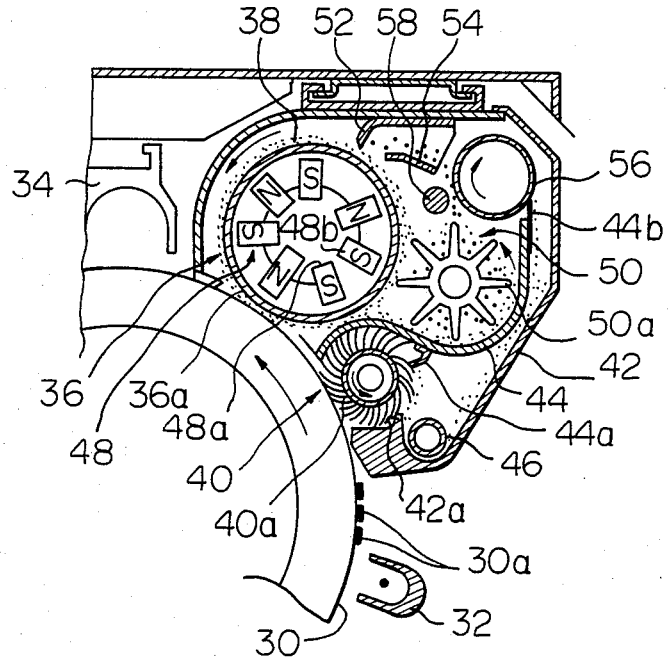
FIG. 2 is a schematic view of a magnet brush cleaning apparatus embodying the present invention.

Referring to FIG. 2, there are shown a magnetic brush cleaning apparatus embodying the present invention and some of the instruments which are arranged around a photoconductive drum 30. The drum 30 comprises a photosensitive outer layer and a conductive inner layer and is driven for rotation at a constant speed as indicated by an arrow. The photosensitive layer is made of a photoconductive material as typified by amorphous selenium or selenium alloy, the conductive layer being grounded. Arranged around the drum 30 are a discharger 32 and a charger 34 as well as other various units (not shown) such as an exposing unit, a developing unit and a transferring unit. The cleaning apparatus of the invention is positioned between the discharger 32 (or transferring unit) and the charger 34. The cleaning apparatus includes a rotary sleeve 36 with a magnet brush 38 formed thereon, and a fur brush 40. The charger 34 uniformly charges the photosensitive layer of the drum 30 to, for example, the positive polarity and, thereafter, the exposing unit exposes the photosensitive layer to image light reflected from an original document thereby electrostatically forming a latent image on the drum 30. The developing unit supplies the drum 30 with a toner which is opposite in polarity to the uniform charge, e.g. negatively charged toner. The resultant toner image has 80% of its toner transferred to a sheet of paper either electrostatically or by mechanical pressure. The toner image carried on the paper sheet will be fixed thereafter in a well known manner. Meanwhile, non-transferred part **30*a* of the toner which remains on the drum 30 after the image transfer arrives at the position where the cleaning apparatus of the invention is located, with or without its electrostatic adhesion force to the drum surface weakened by the discharger 32** which is connected to a high tension power source (not shown) opposite in polarity to the charge on the toner, e.g. positive polarity.

The cleaning apparatus comprises a housing 42 in which the fur brush 40 and sleeve 36 are respectively positioned upstream and downstream with respect to the rotating direction of the drum 30.

The fur brush 40 is journalled to the housing 42 such that the bristles **40*a* carried thereon rub themselves against the drum 30 in the opposite direction to the movement of the drum 30 and at a higher peripheral speed than the drum 30. Preferably, the bristles 40*a* are constituted by conductive filaments. Then, the cleaning efficiency available with the fur brush 40 may be increased by grounding the bristles 40*a* to weaken the electric adhesion between the drum surface and the residual toner or by applying across the bristles 40*a* a bias voltage which is different in polarity from the toner charge. Alternatively, use may be made of rayon filaments or mixture filaments. The fur brush 40 is surrounded by the housing 42 and a partition 44 which is adapted to physically isolate the fur brush 40 from the sleeve 36. A flicker 42*a* is associated with the housing 42 with its free end projected into the bristles 40*a* of the fur brush 40. Likewise, a flicker 44*a* is associated with the partition 44 with its free end projected into the bristles 40*a*. The toner flicked off the bristles 40*a* by the flickers 42*a* and 44*a* will drop to the bottom of the housing 42 where a toner discharging screw 46** is located.

The sleeve 36 has a hollow cylindrical member **36*a* which is journalled to the housing 42 in the vicinity of and in parallel with the drum 30 and movable in the opposite direction to the movement of the drum 30. A bias voltage of the opposite polarity to the toner charge is applied across the cylinder 36***a*. A plurality of magnets 48 are arranged inside the cylinder 36*a* either in fixed positions or to be movable together with the cylinder 36*a*. The magnets 48 generate magnetic lines of force near the periphery of the cylinder 36*a* whereby a magnetic carrier is adhered to the periphery of the cylinder 36*a* to form a magnet brush. The carrier may comprise, for example, iron powder which is used for a two-component developer and has a particle size of about 100–500 mesh. The carrier on the cylinder 36*a* rubs the surface of the drum 30 to cause toner particles remaining on the drum 30 to become deposited thereon, thereby removing the toner particles from the drum surface.

A paddle 50 is located downstream of the drum 30 with respect to the rotating direction of the sleeve 36 so as to be rotatable as indicated by an arrow in the drawing. The paddle 50 extends in parallel with the sleeve 36 and has a plurality of axial flat blades 50*a*. Of the magnets 48 in the cylinder 36*a*, the magnets 48*a* and 48*b* adjacent to the paddle 50 are common in polarity to each other so that the carrier on the cylinder 36*a* will drop from the cylinder 36*a* to accumulate on the partition 44 due to the repulsive magnetic fields of the magnets 48*a* and 48*b*. This part of the carrier is scooped up by the blades 50*a* of the paddle 50 into the recesses formed between the blades 50*a*, thus being conveyed upwardly away from the bottom of the partition 44. The carrier so conveyed by the paddle 50 is returned to the cylinder 36*a* at a position downstream of the carrier scraping position with respect to the rotating direction of the sleeve 36. The carrier is circulated in this manner.

A doctor blade 52 is positioned downstream of the paddle 50 with respect to the rotating direction of the sleeve 36 and spaced a predetermined distance from the periphery of the cylinder 36*a*. Excessive part of the carrier returned from the paddle 50 to the cylinder 36*a* is shaved by the doctor blade 52, so that the carrier is supplied to the surface of the drum 30 always by an adequate amount. The carrier removed by the doctor blade 52 is guided by a guide 54 to drop onto the paddle 50.

A toner collector roller 56 and an electrode 58 are located to face each other at the opposite sides of the carrier drop region which extends from the lower end of the guide 54 to the paddle 50. The toner collector roller 56 is supplied with a bias voltage which is opposite in polarity to the toner charge and higher than the bias voltage applied across the cylinder 36*a*. The roller 56 is driven for rotation such that its surface adjacent to the electrode 58 moves in the opposite direction (upward) to the carrier transferring (dropping) direction. Taking the form of a rod or roller, the electrode 58 extends in parallel with the roller 56 and is connected to ground or supplied with a bias voltage lower than the bias voltage to the roller 56 (polarity is the same). With this arrangement, while the carrier is dropping through the gap between the roller 56 and the electrode 58, the toner deposited thereon becomes electrostatically adhered to the roller 56 due to the electric field developed between the roller 56 and the electrode 58. The carrier released the toner and reached the paddle 50 is mixed with the carrier which has been scraped off the cylinder 36*a* by the paddle 50 into the recess between the adjacent blades 50*a*. The carrier mixture is fed back to the surface of the cylinder 36*a*. A carrier circulation path is set up in this manner.

A wiper blade 44*b* made of metal, rubber or resin is mounted on the partition 44 with its free end engaged with the periphery of the roller 56. The toner thus removed by the wiper blade 44*b* from the roller 36 is let fall into the path between the partition 44 and the housing 42 and then routed to the screw 46, which is located at the bottom of the housing 42. Thus, the screw 46 conveys both the toner removed by the flickers 42*a* and 44*a* out of the bristles 40*a* and the toner removed by the wiper blade 44*b* from the roller 56.

The operation of the cleaning apparatus shown in FIG. 2 will need any further description except that alien particles such as paper powder on the drum surface as well as the toner is prevented from entering the cleaning station. The alien particles are removed by the fur brush 40 at a position downstream of the sleeve 36 which carries the magnet brush or carrier thereon.

It will be noted that the rod- or roller-shaped electrode 58 shown in FIG. 2 may be replaced by a flat plate-like electrode. Preferably, the plate-like electrode is curved along the periphery of the collector roller 56 and, for a higher collection efficiency, located as close to the roller 56 as possible to intensify the electric field. In this case, the spacing between the electrode 58 and the roller 56 should not be too small to facilitate the flow of the carrier; an adequate value may lie within the range of 1–10 mm.

Figure 3:
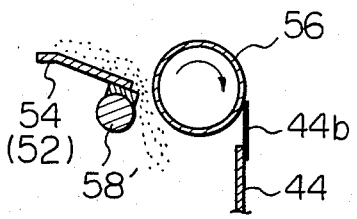
FIGS. 3 and 4 are views of modifications to an electrode which is associated with the apparatus of FIG. 2.
Figure 4:
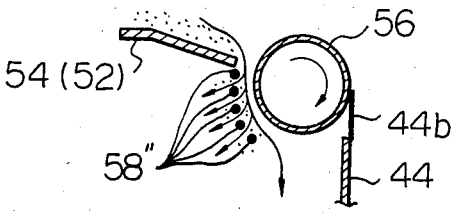

Other possible forms of the electrode which cooperates with the collector roller 56 are illustrated in FIGS. 3 and 4. In FIG. 3, an electrode 58' is mounted on the end of the guide 54 adjacent to the roller 56 or the end of an integral body of the blade 52 and guide 54. In FIG. 4, a plurality of wire electrodes 58" are arranged generally complementary to the contour of the roller 56. This type of arrangement shown in FIG. 4 is particularly advantageous in that the carrier is allowed to flow also through the gaps between the wires 58" without any obstruction. The wires 58" may be of quite a small diameter as long as they will not be susceptible to the flow of the carrier.

To summarize, the carrier which serves as a cleaning agent is always treated to releast the toner therefrom. This prevents the toner density on the carrier on which the toner has been deposited from increasing beyond a certain value. Stated another way, almost all the carrier supplied to the drum 30 is sufficiently capable of allowing the toner to adhere thereto. The resultant cleaning efficiency and life of the carrier are remarkable.

The electrode 58 which is grounded and located near the roller 56 develops a very intense electric field which promotes efficient removal or collection of the toner in between the roller 56 and the electrode 58. Another advantage achievable with the electrode 58 is that the bias voltage to the roller 56 may be lowered without effecting the toner removal efficiency, thereby eliminating leak current or noise while insuring safety operation of the apparatus.

Another factor which enhances the collection efficiency is that the toner adheres to the surface of the roller 56 by the cohesive force and electrostatic force and is positively removed by the wiper blade 44*b* without being separated therebefore. Furthermore, because the roller 56 rotates in the opposite direction to the downward flow of the carrier, the carrier higher in specific gravity than the toner is prevented from adhering to the roller 56 and this not only cuts down the carrier consumption but avoids introduction of the carrier which would make the toner non-reusable.

The toner will be conveniently reused because the part thereof removed from the drum 30 by the fur brush 40 and the other part thereof removed by the magnet brush 38 are removed and collected concentratively.

The absence of a blade or a webbing in this embodiment eliminates damage to the surface of the drum 30 and promotes the use of the cleaning apparatus for various configurations of photoconductive elements, even one having a seam.

The cleaning by the magnet brush 38, in addition to the cleaning by the fur brush 40, frees the apparatus from undesirable phenomena such as toner filming.

Additionally, the cleaning apparatus in accordance with the illustrated embodiment is small-sized while successfully preventing the carrier or toner from being scattered.

Figure 5:
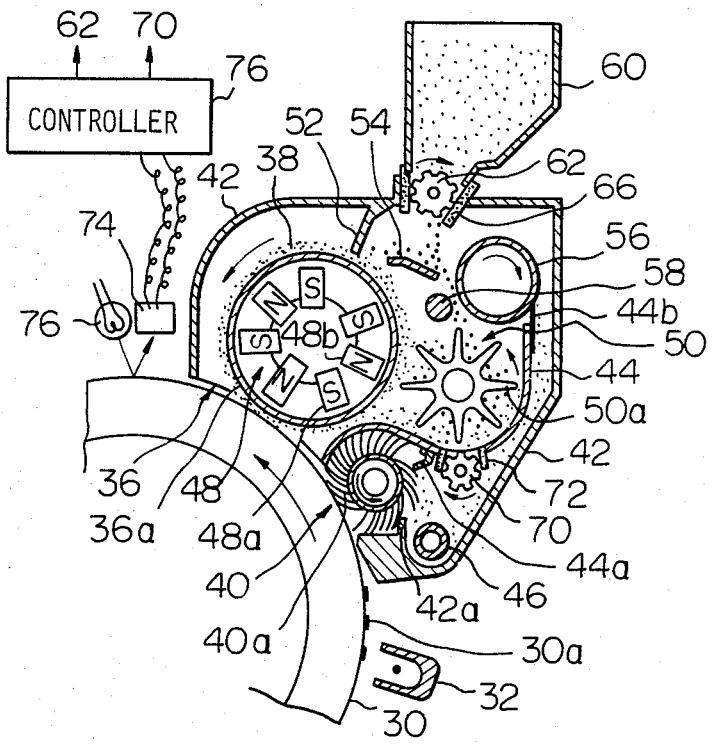
FIG. 5 is a schematic view of another embodiment of the present invention.
Figure 6:
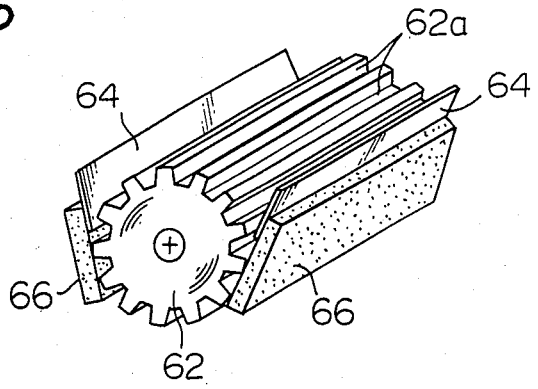
FIG. 6 is a perspective view of a grooved roller included in the apparatus of FIG. 5.

Referring to FIGS. 5 and 6, another embodiment of the present invention is shown in which the same structural elements as those of FIG. 2 are designated by the same reference numerals.

A characteristic feature of the embodiment shown in FIGS. 5 and 6 is that a hopper 60 is mounted on the top of the housing 42 for the supply of fresh magnetic carrier or cleaned magnetic carrier (hereinafter referred to as supplementary carrier for convenience). As best shown in FIG. 6, a roller 62 is located in the bottom opening of the hopper 60. The roller 62 has a substantially same axial dimension as the sleeve 36 and extends substantially in parallel thereto. A plurality of grooves 62*a* are formed axially in the roller 62 and in circumferentially spaced locations. The grooved roller 62 is driven by a motor as indicated by an arrow with or without the intermediary of a clutch or like transmission means. At the opposite sides of the roller 62, a pair of substantially horizontal leaf springs 64 are mounted on the hopper 60 while a block of sponge 66 is fixed to each of the leaf spring 64. The sponge blocks 66, therefore, are resiliently supported and hold the grooved roller 62 therebetween while engaging its periphery at the opposite sides. With this arrangement, the supplementary carrier in the hopper 60 is usually confined thereinside by the grooved roller 62 and coactive sponge blocks 66. As the roller 62 is driven for rotation, a desired amount of the supplementary carrier is let fall onto the guide 54 from the grooves 62*a* so as to be supplied to the carrier circulation path, which extends from the doctor blade 52 to the paddle 50. It will be seen that the supplementary amount of carrier supply depends on the configuration (depth and width) of the grooves 62*a* as well as the rotation amount (speed or angle) of the roller 62.

The partition 44 below the paddle 50 is provided with a roller 70 which extends substantially parallel to the paddle 50 and substantially over the same axial dimension as the paddle 50. The roller 70, like the roller 62, is formed with a plurality of axial grooves and driven by a motor for rotation. Located at substantially opposite sides of the roller 70 are two flat blocks of sponges 72. Engaged with the periphery of the grooved roller 70, the sponge blocks 72 usually prevent the carrier conveyed by the bladed paddle 50 from dropping from the partition 44. Upon rotation of the roller 70, a desired amount of the carrier is let fall onto the screw 46 as in the case of the first grooved roller 62.

Furthermore, a sensor 74 is located downstream of the housing 42 with respect to the direction of rotation of the drum 30, the sensor 72 facing the periphery of the drum 30. A lamp 76 neighbors the sensor 74 to emit light toward the drum 30. The sensor 74 is thus oriented such that the light reflected by the drum 30 becomes incident thereon. A control unit 76 is provided to control the operation of a motor which is adapted to drive the grooved rollers 72 and 70.

In operation, suppose that the carrier has been deteriorated as by toner filming on its periphery, its breakage into pieces or introduction of paper powder or like alien particles thereinto. This degrades the cleaning ability of the magnet brush 38 and thereby allows part of the toner to be left non-wiped by the magnet brush 38. This non-wiped part of the toner on the drum 30 is detected by the sensor 74 as a change in the reflection density of the light emitted from the lamp 76, when the toner reaches the detectable range of the sensor. Then, the control unit 76 drives the motor 62 and 70 associated with the latter in response to the output of the sensor 74. The roller 62 replenishes the carrier from the hopper 60 while the roller 70 discharges the used carrier out from the partition 44. It will be noted that the rollers 62 and 70 may be driven at a desired timing such as during or after a copying operation of the copier; if after a copying operation, the sleeve 36 and paddle 50 will be caused to run idle. It will also be noted that the carrier may be replaced either by the whole part or limited part thereof.

After such replacement of the used carrier with fresh one, the magnetic brush 38 will recover its cleaning ability to successfully remove the toner from the drum surface. The resulting copies will be free from smearing in their background areas or like unusual images.

Thus, in accordance with the second embodiment described above, even though the cleaning ability of the magnet brush may have been degraded for the reasons mentioned, the used carrier is automatically replaced either partly or entirely with fresh carrier to eliminate the need for frequent services for the cleaning apparatus and, thereby, the maintenance cost of the whole machine.

Figure 7:
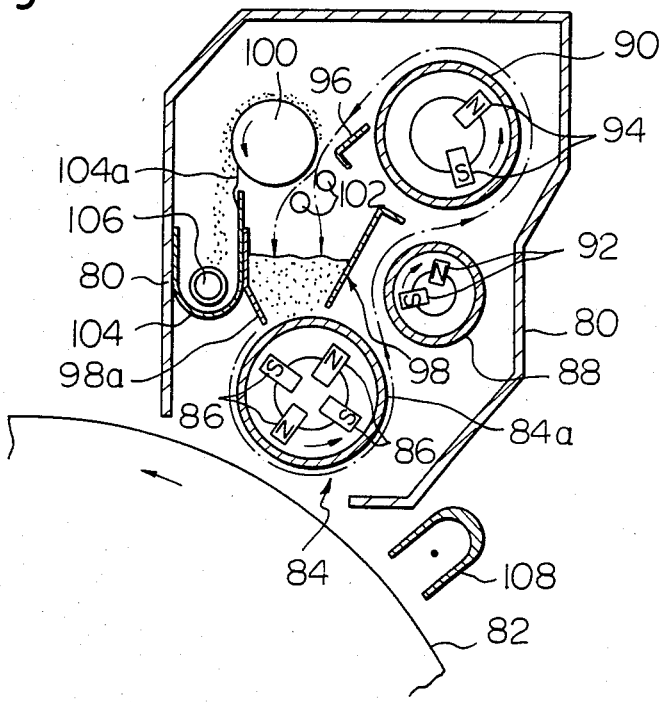
FIG. 7 is a schematic view of still another embodiment of the present invention.

Referring to FIG. 7, another embodiment of the present invention is shown which includes a housing generally designated by the reference numeral 80. A magnet brush is formed on a rotary sleeve 84 which is located adjacent to the periphery of a photoconductive drum 82. The sleeve 84 comprises a hollow cylindrical member 84*a* which extends along and in parallel with the drum 82 and rotates in the opposite direction to the movement of the drum 82. A plurality of magnets 86, such as four as illustrated, are fixed in position within the cylinder 84*a* and arranged such that the N and S poles alternate with each other adjacent to the inner periphery of the cylinder 84*a*. A magnetic carrier is deposited on the cylinder 84*a* to form a brush therearound by the magnetic lines of force which are developed by the magnets 86.

A magnetic roller 88 is positioned at a suitable spacing from the sleeve 84 downstream of the drum 82 with respect to the rotating direction of the sleeve 84. A second magnetic roller 90 is positioned above and at a suitable spacing from the magnetic roller 88. Each of the magnetic rollers 88 and 90 comprises a hollow cylindrical member which extends in parallel with the sleeve 84, while having a plurality of magnets 92 or 94, two in this embodiment, fixed in position thereinside. The magnets 92 or 94 are arranged at a suitable angular spacing such that the N and S poles alternate with each other in the vicinity of the associated cylinder. Further, all the magnets in the apparatus are interrelated such that the magnets 86 and 92 in the position where the sleeve 86 and roller 88 face each other are opposite in polarity and so are the magnets 92 and 94 in the position where the rollers 88 and 90 face each other. The sleeves of the rollers 88 and 90 are driven to rotate in the same direction as the sleeve 84 and roller 88, respectively, at their positions facing the latter. Thus, the magnetic carrier deposited on the cylinder 84*a* is transferred to the roller 88 by the magnetic field developed by the coactive magnets 86 and 92. Likewise, the carrier on the roller 88 is transferred to the roller 90 by the magnetic field developed between the magnets 92 and 94.

A separator 96 is located in a position adjacent to the roller 90 and remote from the magnets 94. The carrier on the roller 90 separates itself therefrom in the position of the separator 96 where the magnetic force associated with the magnets 94 is weaker. Then, the separator 96 guides the carrier along a downward predetermined path.

Disposed above the sleeve 84 is a hopper 98 which is adapted to once store the carrier flown down along the separator 96 and then supply it to the periphery of the sleeve 84. At the downstream side with respect to the movement of the sleeve 84, the hopper 98 has a partition member which serves as a doctor blade 98*a* spaced at its lower end a suitable distance (about 3 mm) from the sleeve 84. The doctor blade 98*a* functions to regulate the thickness of a magnetic toner which is carried on the sleeve 84.

A toner collector roller 100 and a pair of electrodes 102 are located in the region where the magnetic carrier drops from the separator 96. The electrodes 102 are positioned to face the toner collector roller 100 at the opposite sides of the path along which the carrier drops. The roller 100 is impressed with a bias voltage opposite in polarity to the toner charge and driven at a constant speed as indicated by an arrow, while the electrodes 102 and individually connected to ground. The electric field developed between the roller 100 and the electrodes 102 causes the toner, which is carried on the carrier which is dropping therebetween, to be electrostatically attracted by the roller 100 to become supported thereon.

A generally U-shaped toner receiver 104 is interposed between the hopper 98 and the housing 80. A screw conveyor 106 is positioned within the toner receiver 104. A pickoff 104*a* extends upward from the upper end of a side wall of the toner receiver 104 which neighbors the hopper 98, the upper end of the pickoff 104*a* engaging the periphery of the roller 100. With this construction, the pickoff 104*a* shaves the toner off the roller 100 and the conveyor 106 discharges the dropped toner out of the apparatus.

In operation, residual part of the toner on the drum 82 is moved to a discharger 108 in accordance with the rotation of the drum 82. The discharger 108 weakens the electrostatic adhering force of the toner to the drum 82. Then, the toner is removed from the drum by the sleeve 94 on which the magnetic carrier is deposited. That is, the carrier having its width regulated by the doctor blade 98*a* rubs itself against the residual toner and thereby electrostatically attracts the toner away from the drum 82.

The carrier entrains the toner to the area where the sleeve 84*a* faces the magnetic roller 88 in accordance with the rotation of the sleeve 84. The carrier is transferred from the sleeve 84 to the roller 88 along the path indicated by a dash-and-dot line due to the magnetic field developed between the magnets 86 and 92.

The carrier is moved to the position where the roller 90 faces the roller 88, as the roller 88 is progressively rotated. Then, the carrier is transferred from the roller 88 to the roller 90 by the magnetic field developed between the associated magnets 92 and 94. In accordance with the rotation of the roller 90, the carrier is advanced to the separator 96 to be thereby separated from the roller 90 because the magnetic force of the magnets 94 is weaker there.

The carrier is guided by the separator 96 to drop into the hopper 98 through the gap between the roller 100 and the electrodes 102 as indicated by a dash-and-dot line in the drawing. In the course of the downward movement of the carrier, the toner is transferred from the carrier to the roller 100 by the electric field between the roller 100 and the electrodes 102. As a result, the carrier stored in the hopper 98 to serve repeated use as a cleaning agent for the sleeve 84 has its toner concentration constantly suppressed to below a predetermined value (e.g. 5 wt. %).

In the meantime, the toner adhered to the roller 100 is shaved off by the pickoff 104*a* to drop into the toner receiver 104. The screw conveyor 106 conveys the incoming toner out of the apparatus.

Part of the carrier moving along the separator 96 may be partly picked up by suitable means located in the region concerned and fed therefrom to a toner density sensor. This is to vary the bias voltage to the roller 100 in response to a sensed toner density. When the toner density is relatively high, the bias voltage will be increased to enhance the toner collection efficiency; when otherwise, the bias voltage will be decreased. Should the toner density be low, electric leakage would be liable to occur between the roller 100 and the electrodes 102 through the carrier. Despite the lowered bias voltage, the toner density in the hopper 98 will be safety maintained less than the predetermined value due to the low toner density on the carrier. As long as the toner density on the carrier which is flowing down along the separator 96 is high, the resistance of the entire carrier is too high to permit a leak current to flow between the roller 100 and the electrodes 102 while the voltage applied across the roller 100 is kept higher to powerfully collect the toner from the carrier.

It will be seen that the cleaning apparatus described above with reference to FIG. 7 features an excellent toner removing efficiency and, therefore, a remarkably low toner density on the carrier, because the carrier is once collected substantially entirely from the sleeve 84 before the toner is separated therefrom.

Various modifications will become possible for those skilled in the art after receiving the teachings of the present disclosure without departing from the scope thereof.

What is claimed is:

1. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

means for removing the cleaning agent and residual toner from the magnet brush and feeding the cleaning agent and residual toner into a circulatory cleaning agent supply path;

electric field producing means for producing an electric field in the circulatory cleaning agent supply path and separating the toner collected after the cleaning by the magnet brush means and the cleaning agent from each other; and cleaning agent supply means for supplying the cleaning agent separated from the toner to the magnet brush means.

2. A cleaning apparatus as claimed in claim 1, in which the cleaning agent comprises a magnetic carrier.

3. A cleaning apparatus as claimed in claim 1, in which the magnet brush means comprises a hollow cylindrical sleeve which is rotatable in the opposite direction to the movement of the surface of the photoconductive element and impressed with a bias voltage opposite in polarity to a charge deposited on the residual toner.

4. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other; and cleaning agent supply means for supplying the cleaning agent separated from the toner to the magnet brush means;

the magnet brush means comprising a hollow cylindrical sleeve which is rotatable in the opposite direction to the movement of the surface of the photoconductive element and impressed with a bias voltage opposite in polarity to a charge deposited on the residual toner;

the electric field producing means comprising a conductive roller for attracting the collected residual toner to support the toner thereon and electrode means which is located to face said conductive roller through the cleaning agent supply path.

5. A cleaning apparatus as claimed in claim 4, in which a bias voltage opposite in polarity to the charge on the residual toner and higher than the bias voltage to the sleeve is applied across the conductive roller.

6. A cleaning apparatus as claimed in claim 4, in which the electrode means is grounded.

7. A cleaning apparatus as claimed in claim 5, in which a bias voltage lower than and common in polarity to the bias voltage applied across the conductive roller is applied across the electrode means.

8. A cleaning apparatus as claimed in claim 4, in which the electrode means comprises a single roller- or rod-shaped electrode.

9. A cleaning apparatus as claimed in claim 4, in which the electrode means comprises a pair of roller- or rod-shaped electrodes.

10. A cleaning apparatus as claimed in claim 4, in which the electrode means comprises a single flat electrode.

11. A cleaning apparatus as claimed in claim 10, in which the flat electrode is curved along the periphery of the conductive roller and located in the vicinity of said periphery.

12. A cleaning apparatus as claimed in claim 4, in which the electrode means comprises a plurality of relatively thin wire-shaped electrodes which are arranged at spaced locations along the periphery of the conductive roller.

13. A cleaning apparatus as claimed in claim 1, in which the cleaning agent supply means comprises a paddle.

14. A cleaning apparatus as claimed in claim 13, in which the paddle is formed with a plurality of radially extending flat blades.

15. A cleaning apparatus as claimed in claim 1, in which the cleaning agent supply means comprises magnetic roller means for causing the residual toner collected after the cleaning by the magnet brush means and the cleaning agent to circulate, and a hopper for once storing the cleaning agent separated by the electric field developing means while supplying the cleaning agent to the magnet brush means.

16. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other;

cleaning agent supply means for supplying the cleaning agent separated from the toner to the magnet brush means; and blade means for removing the residual toner and cleaning agent from the magnet brush means after the cleaning by the magnet brush means, and guide means for guiding the removed toner and cleaning agent to the electric field producing means.

17. A cleaning apparatus as claimed in claim 1, further comprising charge dissipating or discharging means for reducing a charge deposited on the residual toner on the photoconductive element, said charge dissipating means being supplied with a bias voltage which is opposite in polarity to the charge on the residual toner.

18. A cleaning apparatus as claimed in claim 17, in which the charge dissipating means is located upstream of the magnet brush means with respect to an intended direction of movement of the photoconductive element.

19. A cleaning apparatus as claimed in claim 1, further comprising fur brush means for slidingly engaging the surface of the photoconductive element, while rotating at a speed higher than the moving speed of the surface of the photoconductive element.

20. A cleaning apparatus as claimed in claim 19, in which the fur brush means has bristles set on the periphery thereof.

21. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other;

cleaning agent supply means for supplying the cleaning agent separated from the toner to the magnet brush means; and fur brush means for slidingly engaging the surface of the photoconductive element, while rotating at a speed higher than the moving speed of the surface of the photoconductive element;

the fur brush means having bristles set on the periphery thereof;

the bristles being grounded.

22. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other;

cleaning agent supply means for supplying the cleaning agent separated from the toner to the magnet brush means; and fur brush means for slidingly engaging the surface of the photoconductive element, while rotating at a speed higher than the moving speed of the surface of the photoconductive element;

the fur brush means having bristles set on the periphery thereof;

the bristles being supplied with a bias voltage thereacross which is opposite in polarity to a charge on the residual toner.

23. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other;

cleaning agent supply means for supplying the cleaning agent separated from the toner to the magnet brush means;

fur brush means for slidingly engaging the surface of the photoconductive element, while rotating at a speed higher than the moving speed of the surface of the photoconductive element;

the fur brush means having bristles set on the periphery thereof; and a housing for accommodating therein the magnet brush means, electric field producing means, cleaning agent supply means and fur brush means.

24. A cleaning apparatus as claimed in claim 23, further comprising a partition for physically isolating the fur brush means from the other means.

25. A magnet brush cleaning apparatus for removing residual toner left non-transferred on a photoconductive element, comprising:

rotatable magnet brush means for cleaning the surface of the photoconductive element by forming a magnet brush by a cleaning agent and attracting the residual toner to support the residual toner on said magnet brush;

electric field producing means for producing an electric field in a circulatory cleaning agent supply path and separating the toner collected after the cleaning by the magnet brush means and the cleaning agent from each other;

cleaning agent supply means for supplying the cleaning agent separated from the toner to the magnet brush means; and cleaning agent replacing means for replenishing a fresh cleaning agent and discharging the collected cleaning agent.

26. A cleaning apparatus as claimed in claim 25, in which the cleaning agent replacing means comprises a fresh cleaning agent replenishing means which comprises a hopper for storing the fresh cleaning agent, a rotatable roller positioned in an opening formed at the bottom of the hopper and formed with a plurality of circumferentially spaced grooves in the periphery thereof, and a pair of leaf springs and a pair of blocks of sponge associated with said respective leaf springs, said associated springs and sponge blocks being located at opposite sides of the roller, respectively.

27. A cleaning apparatus as claimed in claim 26, in which the supplementary amount of fresh cleaning agent to be replenished by the fresh cleaning agent replenishing means is determined in accordance with a width and depth of the roller and a rotation speed of the roller.

28. A cleaning apparatus as claimed in claim 25, in which the cleaning agent replacing means further comprises a rotatable roller located below the cleaning agent supply means and formed with a plurality of circumferentially spaced grooves, and a pair of sponge blocks arranged at opposite sides of said roller, respectively.

29. A cleaning apparatus as claimed in claim 25, further comprising sensor means for sensing and descriminating a cleaning ability of the apparatus.

30. A cleaning apparatus as claimed in claim 29, in which the supplementary amount of fresh cleaning agent to be supplied by the cleaning agent replacing means and the amount of the collected cleaning agent to be discharged by said means are adjustable in response to an output of the sensor means.

* * * * *